United States Patent [19]

Ting-Ching

[11] 4,432,653

[45] Feb. 21, 1984

[54] WRIST WATCH

[76] Inventor: Wu Ting-Ching, No. 1, Alley 64, Lane 193, Han Sheng E. Rd., Pan Chiao, Taipei, Taiwan

[21] Appl. No.: 449,564

[22] Filed: Dec. 13, 1982

[51] Int. Cl.[3] ..... G04C 21/16

[52] U.S. Cl. ..... 368/250

[58] Field of Search ..... 368/10, 12, 72–74, 368/243, 244, 250, 251

[56] References Cited

U.S. PATENT DOCUMENTS

| | | | |
|---|---|---|---|
| 3,255,582 | 6/1966 | Zam | 368/250 |
| 3,938,317 | 2/1976 | Spano | 368/230 X |
| 4,028,882 | 6/1977 | Muncheryan | 368/250 X |
| 4,047,377 | 9/1977 | Banks, Jr. | 368/250 X |

FOREIGN PATENT DOCUMENTS

| | | | |
|---|---|---|---|
| 618827 | 8/1980 | Switzerland | 368/230 |

*Primary Examiner*—Vit W. Miska

*Attorney, Agent, or Firm*—Shoemaker and Mattare, Ltd.

[57] ABSTRACT

A wrist watch having an electric powered timing unit for providing time information, an alarm unit coupled to the timing unit, and a pair of electrodes coupled to the alarm unit and being arranged to be in contact with the surface of the wrist of the wearer of the watch; the timing unit being provided with a set switch for setting an alarm time at which the timing unit produces an instant pulse which triggers the alarm unit to produce an intermittent high voltage across the pair of electrodes so as to alert the wearer of the watch.

3 Claims, 6 Drawing Figures

WRIST WATCH

BACKGROUND OF THE INVENTION

This invention relates to a wrist watch, and more particularly to a wrist watch having an alarm unit which produces an electric stimulus at a pre-set time to alert the wearer of the watch.

Conventional wrist watches having an alarm unit generally produce an alarm sound of various forms. Unfortunatly, such conventional wrist watches are convenient but the alarm sounds they produce tend to disturb other people near the wearers of the watch.

In view of aforesaid problem with conventional wrist watches the present invention offers a novel wrist watch having an alarm unit capable of producing at a pre-determined time an electric stimulus for alerting the person who wears the watch, without producing sounds that may disturb nearby people.

Therefore, it is the main object of this invention to provide a wrist watch having an alarm unit that produces at a pre-determined time a silent alarm capable of alerting the wearer of the watch, without disturbing nearby people.

SUMMARY OF THE INVENTION

This invention provides a wrist watch having an alarm unit capable of producing an electric stimulus to the wearer of the watch at a pre-determined time without producing sounds, wherein the wrist watch comprises a timing unit having a time piece IC capable of producing an electric pulse at a pre-determined time, a signal generator adapted to produce a high voltage signal upon receipt of the electric pulse produced by the time piece IC and a pair of electrodes to which the high voltage signal produced by the signal generator is applied; the pair of electrodes being exposed on the backside of the watch to come in contact with the surface of the wrist of the wearer of the watch so that the high voltage signal applied to the electrodes stimulates the wrist surface at the point of contact and alerts the wearer of the watch. The high voltage signal is of very low power rating and is applied instantly and intermittently and therefore is not hazardous to human beings.

DETAILED DESCRIPTION OF THE INVENTION

Figure 1:
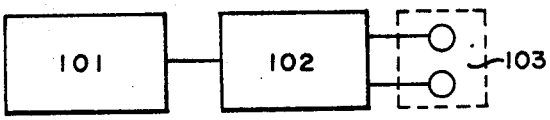
FIG. 1 is a block diagram of the alarm watch of this invention.

As shown in FIG. 1, the wrist watch of this invention comprises a timing unit 101 having an electric powered time-piece circuit provided with switches for setting the alarm time, and being capable of producing an electric pulse at a pre-set alarm time; an alarm unit 102 adapted to produce a high voltage signal upon receipt of the electric pulse produced by the timing unit 101, and a pair of electrodes 103 to which the high voltage signal produced from the alarm unit 102 is applied, the pair of electrodes 103 being arranged to be in contact with the surface of the wrist of the wearer of the watch.

Figure 2:
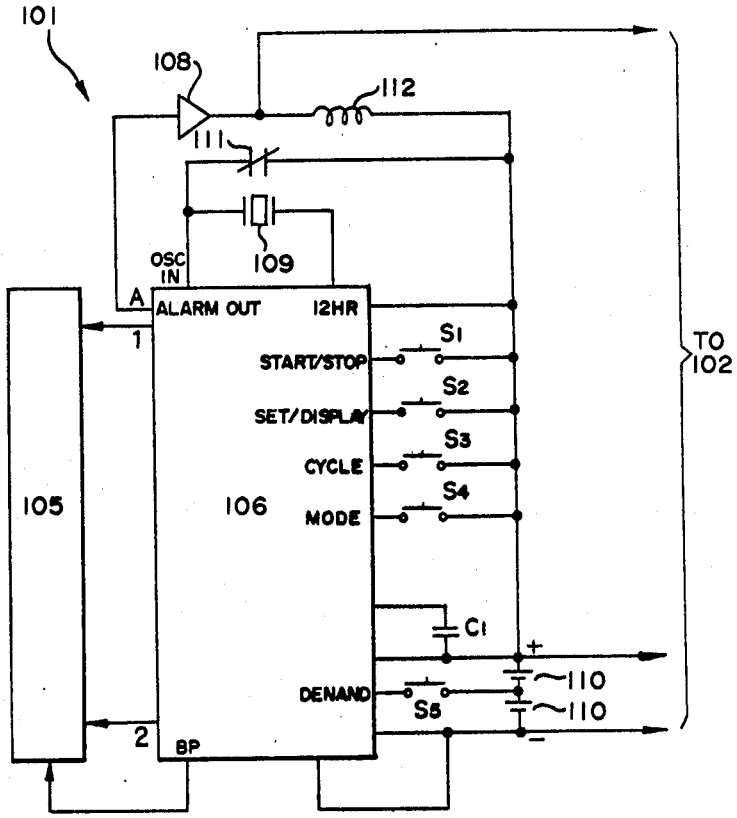
FIG. 2 is an electric circuit diagram of the timing unit employed in the wrist watch of this invention.

As shown in FIG. 2, timing unit 101 comprises a large scale integrated circuit (or LS1) 106 operable by electric power to provide time information through terminals 1 and 2 and an output signal through terminal A, said LS1 106 having switches S1, S2, S3, S4 and S5 to perform respectivly the functions of start/stop, set/display, 50/60 HZ selection, selection of 12/24 hours and demand control, wherein switch S2 is adapted to set the alarm time at which LS1 106 is capable of producing an electric pulse signal; a pair of batteries 110 to supply electric power to LS1 106 as well as the alarm unit 102; a crystal 109 connected to LS1 106 to provide accurate clock frequency of the time information produced by LS1 106; a variable capacitor 111 to enable the fine adjustment of the clock frequency; a display unit 105 coupled to LS1 106 for displaying the time information produced by LSI 106; and a power amplifier 108 connecting terminal a with alarm unit 102 to be described later, said amplifier 108 being also connected to coil 112 which is connected to batteries 110 so as to amplify the output signal produced by LSI 106.

Figure 3:
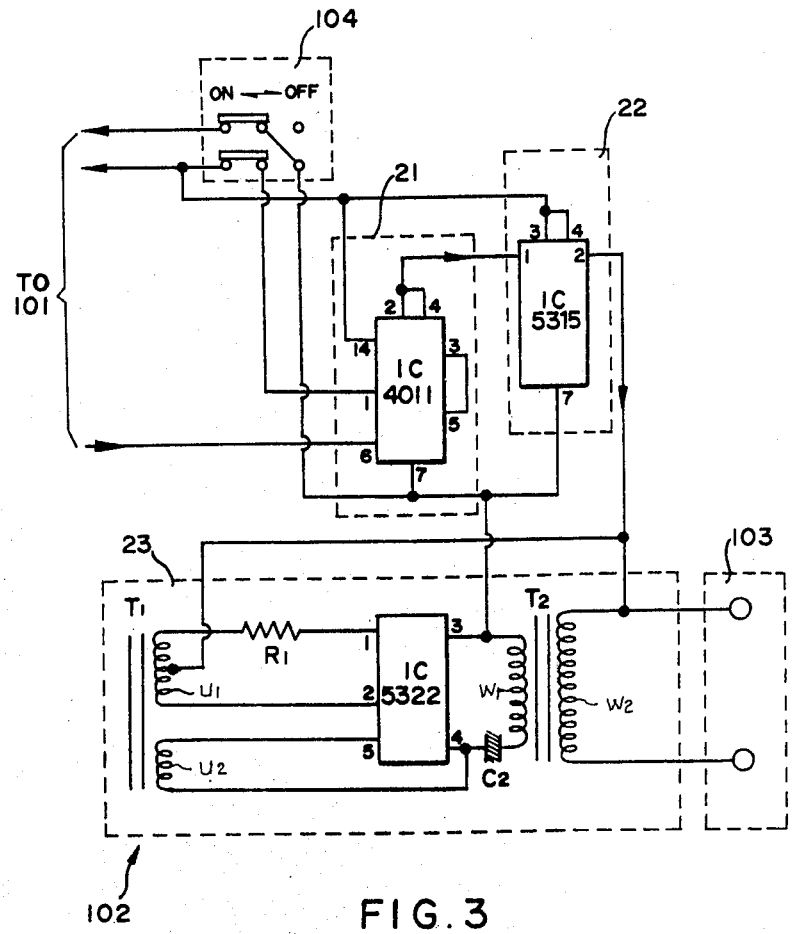
FIG. 3 is an electric circuit diagram of the alarm unit employed in the wrist watch of this invention.

Alarm unit 102 as shown in FIG. 3 comprises a memory unit 21 having an IC 4011 provided with terminals 1, 2, 3, 4, 5, 7 and 14, wherein the output signal produced by timing unit 101 is applied to terminal 6; a switching unit 22 having an IC 5135 provided with terminals 1, 2, 3, 4 and 7; wherein terminal 1 is connected to terminals 2 and 4 of IC 4011 of memory unit 21; and a signal generator 23 having an IC 5322 provided with terminals 1, 2, 3, 4, and 5, an input transformer T1 and an output transformer T2, input transformer T1 having a primary winding U1 and resistor R1 connected across terminals 1 and 2 of IC 5322 and a secondary winding U2 connected across terminals 5 and 4 of IC 5322; output transformer having a primary winding W1 with one end connected with high voltage capacitor C2 which is then connected to terminal 4, and another end connected to terminal 3 of IC 5322 so as to constitute a multivibrator, and a secondary winding W2 connected across the pair of electrodes 103. Alarm unit 102 is further provided with slide switch 104 to selectively supply a 3.0 V electric power from two batteries 110 each producing 1.5 V electric power to terminals 1 and 7 of memory unit 21.

With slide switch 104 turned on, timing unit 101 delivers a steady 3.0 V output signal, or voltage to terminal 6 of memory unit 21 which in turn delivers a 0.2 V output signal from terminals 2 and 4 of IC 4011 to terminal 1 of IC 5135 of switching unit 22 which is thus kept inoperative, along with signal generator 23 which is also kept inoperative. As soon as timing unit 101 operates to the pre-set alarm time, LSI 106 of timing unit 101 acts to change the 3.0 V steadly output into 0.2 V instant pulse signal at the moment of the set alarm time, which causes the 0.2 V output that has been produced by IC 4011 through terminals 2 and 4 to change into a steady 3.0 V output signal to activate switching unit 22. As a result a steady 3.0 V electric power is supplied from switching unit 22 to signal generator 23.

The 3.0 V electric power is supplied to the multivibrator which comprises input transformer T1, resistor R1 and IC 5322. The multivibrator then generates an 115 V intermittent alternating voltage, which is further transformed by output transformer T2 into a 800 V intermittent voltage to be applied across the pair of electrodes 103.

The 800 V intermittent voltage is provided at a time cycle of once every second, which stimulates the wearer of the alarm watch until slide switch 104 is turned off to stop the operation of the alarm unit. The stimulus created by the 800 V instant voltage is similar in mildness to that of a mosquits bite and does not present hazard to the human body.

Figure 4:
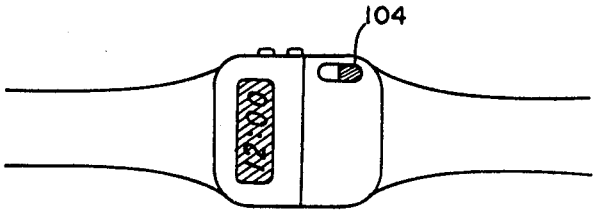
FIG. 4 is a schematic plan view of the wrist watch of this invention, showing the arrangement of the side switch in a preferred embodiment of the wrist watch of this invention.
Figure 5:
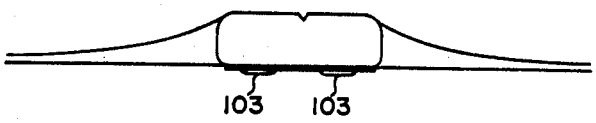
FIG. 5 is a schematic side view of the wrist watch of this invention, showing an embodiment of the pair of electrodes.
Figure 6:
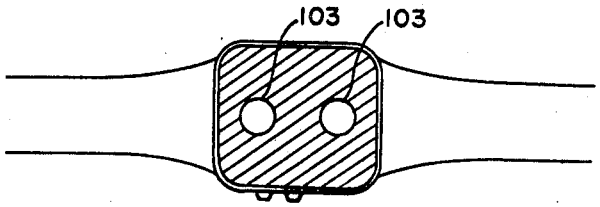
FIG. 6 is a schematic bottom view of the wrist watch of this invention, showing an embodiment of the pair of electrodes.

The alarm watch of this invention can be conveniently made in a style as shown in FIGS. 4, 5 and 6, wherein slide switch 104 is provided on one corner of the face of the watch and the pair of electrodes 103 are provided on the backside of the watch.

Display unit 5 according to the preferred embodiment is a digital device. However, it is to be understood that display unit 5 can be replaced by other device such as a dial type clock piece without departing the spirit and scope of this invention as defined in the appended claims.

I claim:

1. A wrist watch, comprising:

a timing unit having an electric powered time piece circuit capable of providing time information and provided with switches for pre-setting alarm time and being capable of producing an electric pulse at the moment of a pre-set alarm time, and a display unit for showing the time information supplied by said time piece circuit;

an alarm unit having:

a memory unit adapted to receive and convert said electric pulse into a steady electric output;

a switching unit operable by said steady electric output produced by said memory unit to allow electric power to be supplied therethrough;

a signal generator capable of transforming an electric power supplied thereto through said switching unit into an intermittent, alternating voltage capable of stimulating people; and a pair of electrodes to which said intermittent, alternating voltage is supplied, said pair of electrodes being exposed through the back side of the alarm watch.

2. A wrist watch as recited in claim 1, wherein said display unit is a digital display device.

3. A wrist watch as recited in claim 1, wherein said display device is a dial type clock piece.

* * * * *